US009541009B2

(12) United States Patent
Nishimura et al.

(10) Patent No.: US 9,541,009 B2
(45) Date of Patent: Jan. 10, 2017

(54) INTAKE DEVICE

(75) Inventors: Etsuo Nishimura, Kanagawa (JP); Yasuhiro Tochigi, Kanagawa (JP); Hiroyuki Yanazawa, Kanagawa (JP)

(73) Assignee: MIKUNI CORPORATION, Tokyo (JP)

( * ) Notice: Subject to any disclaimer, the term of this patent is extended or adjusted under 35 U.S.C. 154(b) by 253 days.

(21) Appl. No.: 14/118,064

(22) PCT Filed: May 15, 2012

(86) PCT No.: PCT/JP2012/062366

§ 371 (c)(1),
(2), (4) Date: Nov. 15, 2013

(87) PCT Pub. No.: WO2012/157626

PCT Pub. Date: Nov. 22, 2012

(65) Prior Publication Data

US 2014/0102410 A1 Apr. 17, 2014

(30) Foreign Application Priority Data

May 19, 2011 (JP) ..... 2011-112440

(51) Int. Cl.
*F02D 9/02* (2006.01)
*F02D 9/10* (2006.01)
(Continued)

(52) U.S. Cl.
CPC ..... *F02D 9/02* (2013.01); *F02D 9/1065* (2013.01); *F02D 11/10* (2013.01);
(Continued)

(58) Field of Classification Search
CPC ..... F02D 9/02; F02D 9/108; F02D 9/1065; F02D 11/10; F02D 2011/102; F02M 35/10321; F02M 35/10354
(Continued)

(56) References Cited

U.S. PATENT DOCUMENTS 6,047,680 A * 4/2000 Shimura ..... F02D 11/10 123/336
6,116,215 A * 9/2000 Soleanicov ..... F02D 9/02 123/337
(Continued)

FOREIGN PATENT DOCUMENTS

JP S38-017217 Y1 8/1963
JP S58-146458 10/1983
(Continued)

OTHER PUBLICATIONS

International Search Report Issued in PCT/JP2012/062366 on Aug. 28, 2012.
(Continued)

*Primary Examiner* — Stephen K Cronin
*Assistant Examiner* — Susan E Scharpf
(74) *Attorney, Agent, or Firm* — Paul F. Neils, Esq.; Edwards Neils LLC

(57) ABSTRACT

An air intake device offers simplified construction, reduced size, lowered cost, etc., while facilitating disposing of throttle body and driving part in intake air passage, allowing throttle body to be reliably held, and eliminating possible occurrence of intake air leakage, etc., thus positively securing the performance. The air intake device includes an actuator and an intake air manifold made of resin. In actuator, there are provided a throttle body, a throttle valve, a motor for opening/closing throttle valve, and a power transmission mechanism. Throttle valve and motor are positioned and held on one side of a support member, and power transmission mechanism is on the other side. In intake air manifold, a housing chamber is provided. When a fixing part of support member is jointed to a part to be fixed of intake air manifold, throttle body and motor are accommodated in a predetermined position in housing chamber.

6 Claims, 16 Drawing Sheets

(51) Int. Cl.
*F02M 35/10* (2006.01)
*F02D 11/10* (2006.01)

(52) U.S. Cl.
CPC *F02M 35/10321* (2013.01); *F02M 35/10354* (2013.01); *F02D 9/108* (2013.01); *F02D 2011/102* (2013.01)

(58) Field of Classification Search
USPC ..... 123/319, 399
See application file for complete search history.

(56) References Cited

U.S. PATENT DOCUMENTS 6,235,231 B1 * 5/2001 Martin ..... B29C 45/2628 264/328.1
7,011,073 B2 * 3/2006 Hannewald ..... F02D 9/104 123/337
7,117,845 B2 * 10/2006 Iwaoka ..... F02D 11/10 123/337
2001/0052332 A1 * 12/2001 Itoh ..... F02B 61/045 123/184.42
2003/0024496 A1 2/2003 Tachibana et al.
2006/0000445 A1 1/2006 Iwaoka et al.
2006/0157027 A1 * 7/2006 Ichikawa ..... F02D 9/105 123/399
2006/0169223 A1 * 8/2006 Tabata ..... F01P 3/12 123/41.31
2007/0017491 A1 1/2007 Maeda
2007/0144483 A1 * 6/2007 Torii ..... F02D 9/103 123/337
2014/0116372 A1 * 5/2014 Nishimura ..... F02M 35/10255 123/184.46

FOREIGN PATENT DOCUMENTS

JP 2001-346351 A 12/2001
JP 2003-049726 A 2/2003
JP 2005-233146 A 9/2005
JP 2007-023954 A 2/2007
JP 2009-150252 A 7/2009
JP 2010-116794 A 5/2010

OTHER PUBLICATIONS

Extended European Search Report issued on Oct. 30, 2014 in connection with European Patent Application No. 12785109.5.

* cited by examiner

INTAKE DEVICE

CROSS-REFERENCE TO RELATED APPLICATIONS

The present invention is a 35 U.S.C. 371 National Stage Entry of PCT/JP2012/062366, filed May 15, 2012, which claims priority from Japanese Patent Application No. 2011-112440, filed on May 19, 2011, the contents of all of which are herein incorporated by reference in their entirety.

TECHNICAL FIELD

The present invention relates to an air intake device for an internal combustion engine, and particularly to an air intake device which opens/closes an intake air passage with a throttle valve.

BACKGROUND ART

With an electronic throttle device disclosed in the following Patent Document 1, a throttle body including a throttle valve is integrally molded with an intake air manifold, being made of resin material, and a driving part including a motor for rotating the throttle valve and a gear mechanism for transmitting power of the motor to the throttle valve is connected to the throttle body by welding. Further, with an air intake device disclosed in the following Patent Document 2, a connection pipe formed in a throttle body which integrally includes a motor for rotating a throttle valve is screwed to a connection pipe holding part formed in an intake air manifold, and a flange in the throttle body is fastened to that in the intake air manifold with a bolt, thereby the throttle body including a driving part being connected to the intake air manifold.

Patent document 1: Japanese Unexamined Patent Application Publication No. 2005-233146

Patent document 2: Japanese Unexamined Patent Application Publication No. 2010-116794

DISCLOSURE OF THE INVENTION

Problems to be Solved by the Invention

With the electronic throttle device disclosed in Patent Document 1, the throttle body made of resin material tends to be deformed under the influence of manufacturing error, heat, or the like, and there is a possibility that an intake air leakage may be caused from a clearance produced in a deformed portion, thereby the air intake performance being deteriorated. In addition, in order to mount the driving part to the throttle body, a construction which divides the throttle shaft for supporting the throttle valve into two and links them to each other is taken, thereby it being difficult to control the throttle valve with high accuracy. Further, in order to link between shafts, a high manufacturing accuracy is required, resulting in an increase in manufacturing cost. With the air intake device disclosed in Patent Document 2, there is a possibility that the bolt fastening the flange in the throttle body to that in the intake air manifold may be loosened due to a vibration of the motor, and the like, resulting in the throttle body coming off from the intake air manifold, and therefore the throttle body cannot be reliably held on the intake air manifold. In addition, in order to reliably hold the throttle body including the motor by means of the flange part, the flange in the throttle body mounting part is required to have a rigidity to withstand the weight of the motor, which requires to take such a measure as increasing the size or thickness of the flange, thereby there occurring a possibility that the size or weight may have to be greatly increased.

In view of the above-mentioned problems, the present invention has been made, and it is an object of the present invention to provide an air intake device which offers such advantages as simplified construction, reduced size, and lowered cost, while facilitating disposing of the throttle body and driving part in the intake air passage, allowing the throttle body to be reliably held, and eliminating the possible occurrence of intake air leakage, and the like, thus positively securing the performance.

Means for Solving the Problems

In order to solve such problems, in one aspect of the present invention, there is provided an air intake device, including: a throttle body for defining a throttle bore; a throttle valve for opening/closing the throttle bore; a motor for driving the throttle valve to open/close the same; a power transmission mechanism for transmitting drive power of the motor to the throttle valve; a support member for positioning and holding, on one side, the throttle body and the motor, and positioning and holding, on the other side, the power transmission mechanism; and a passage member formed of a resin material for defining an intake air passage together with the throttle bore, wherein the passage member is provided with a housing chamber for accommodating the throttle body and the motor.

In another aspect of the present invention, there is provided an air intake device, in which the support member has a fixing part formed so as to be jointed to the passage member, and, with the fixing part being jointed to the passage member, the throttle body and the motor are accommodated in a predetermined position in the housing chamber.

In another aspect of the present invention, there is provided an air intake device, in which, in the housing chamber of the passage member, there are provided a fitting part to be engaged with an end face of the throttle bore, and a guide face for guiding the throttle body into the housing chamber, leading it to a predetermined position such that the end face of the throttle bore and the fitting part are engaged with each other.

In another aspect of the present invention, there is provided an air intake device, in which the support member is jointed to the passage member such that an accommodation opening in the housing chamber is blocked.

In another aspect of the present invention, there is provided an air intake device, in which the passage member is an intake air manifold.

In another aspect of the present invention, there is provided an air intake device, in which, between the motor and the housing chamber, there is interposed an urging member for urging the motor in a direction reverse to the direction of insertion of the motor into the housing chamber.

In another aspect of the present invention, there is provided an air intake device, in which the fixing part has an elastically deformable engaging pawl, and the support member is jointed to the passage member with the engaging pawl being engaged with the passage member.

In another aspect of the present invention, there is provided an air intake device, in which the fixing part has a projecting part, the outer peripheral face thereof having a through-hole opened therein, and the support member is jointed to the passage member by means of an engaging member inserted into the through-hole for engaging the support member with the passage member.

Advantages of the Invention

In accordance with the present invention, it is capable of offering such advantages as simplified construction, reduced size, and lowered cost, while facilitating disposing of the throttle body and driving part in a predetermined position, and allowing the throttle body to be reliably held without being influenced by the motor, and the like.

BEST MODE FOR CARRYING OUT THE INVENTION

Hereinbelow, one embodiment of the present invention will be explained with reference to the drawings.

Figure 1:
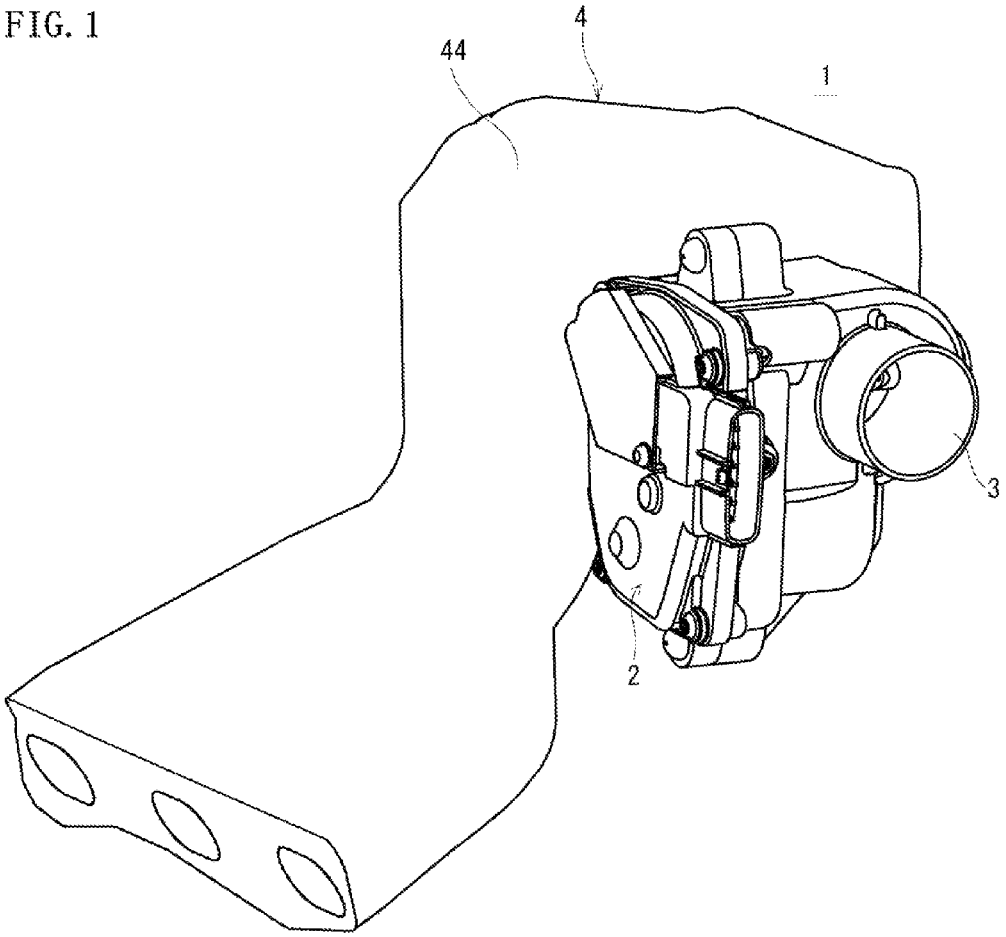
FIG. 1 is a perspective view showing an air intake device in one embodiment of the present invention.

As shown in FIG. 1, an air intake device 1 includes a throttle control device 2, and an intake air manifold 4 which defines an intake air passage 3.

Figure 2A:
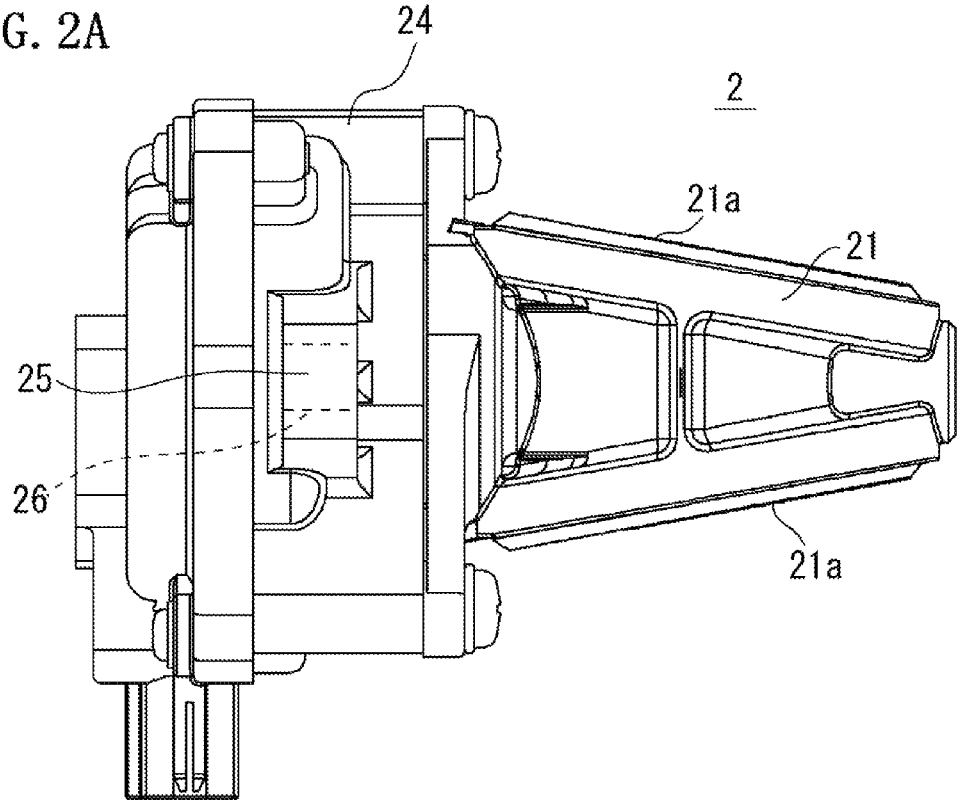
FIG. 2(*a*) and FIG. 2(*b*) are drawings showing a throttle control device in FIG. 1.
Figure 2B:
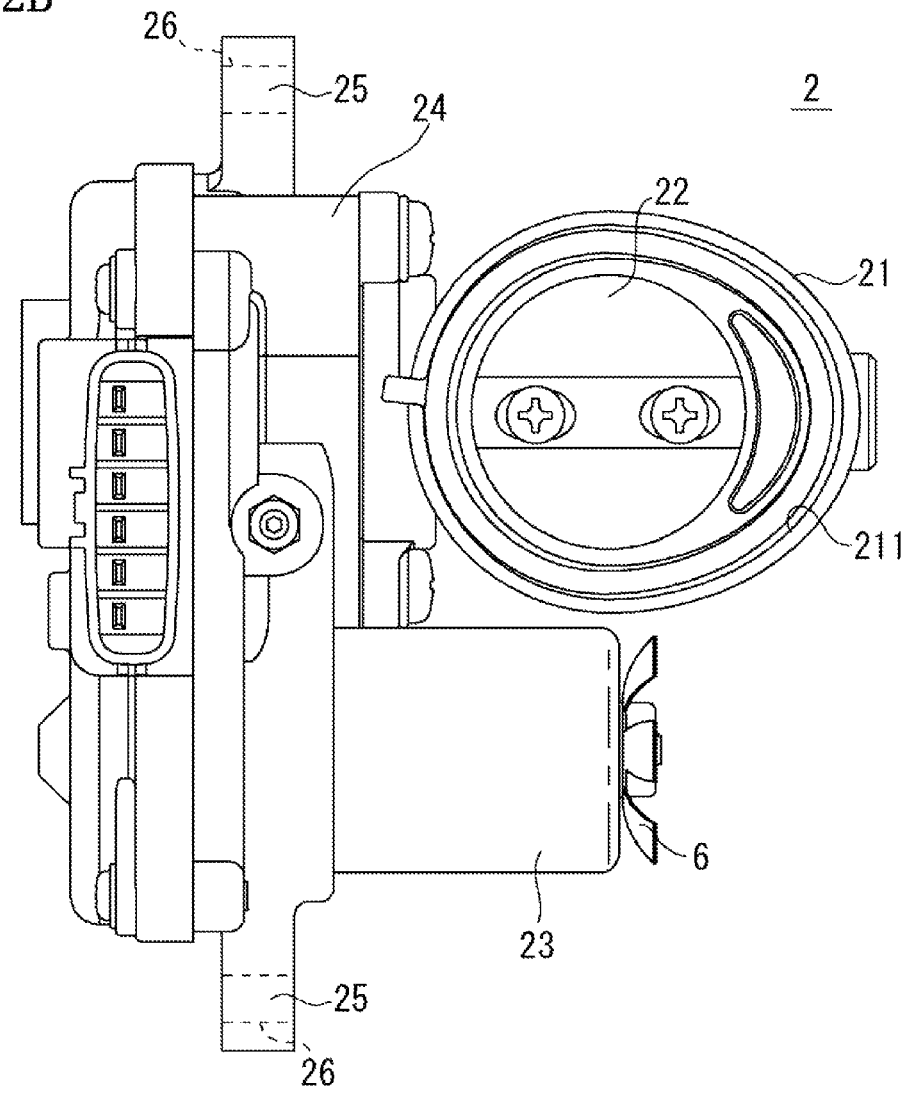
Figure 3:
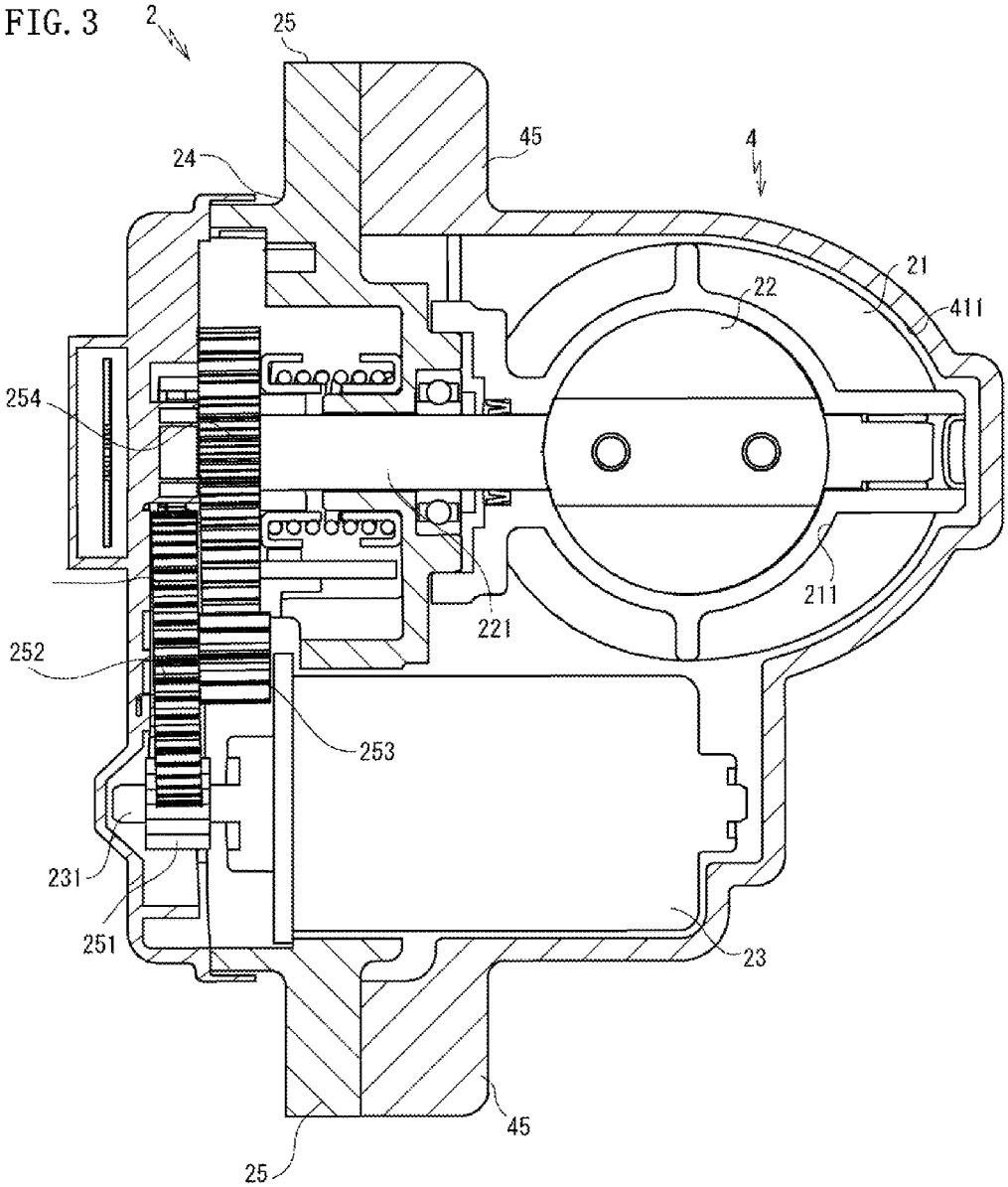
FIG. 3 is a sectional view showing the throttle control device in FIG. 1.

As shown in FIG. 2(*a*), FIG. 2(*b*), and FIG. 3, the throttle control device 2 includes a throttle body 21 which defines a throttle bore 211; a throttle valve 22 which opens/closes the throttle bore 211; a motor 23 which drives the throttle valve 22 to open/close the same; and a power transmission mechanism for transmitting driving power of the motor 23 to the throttle valve 22.

The throttle body 21 and the motor 23 are located on one side of a support member 24.

Further, the power transmission mechanism is incorporated, being positioned on the other side of the support member 24. The power transmission mechanism includes a gear 251 which is fixed to a rotating shaft 231 of the motor 23; a gear 252 which is meshed with the gear 251; a gear 253 which is rotated integrally with the gear 252; and a gear 254 which is fixed to a rotating shaft 221 of the throttle valve 22, being meshed with the gear 253. The gear 252 and the gear 253 are supported by a rotating shaft which is pivoted to the support member 24.

Both end faces 21*a* of the throttle body 21 provide a tapered flange face. At an end face of the motor 23, a leaf spring 6 is mounted. The support member 24 is provided with a fixing part 25 which is jointed to the intake air manifold 4. In the fixing part 25, there is formed a through-hole 26 penetrating through the fixing part 25 in the direction of jointing to the intake air manifold 4.

Figure 4:
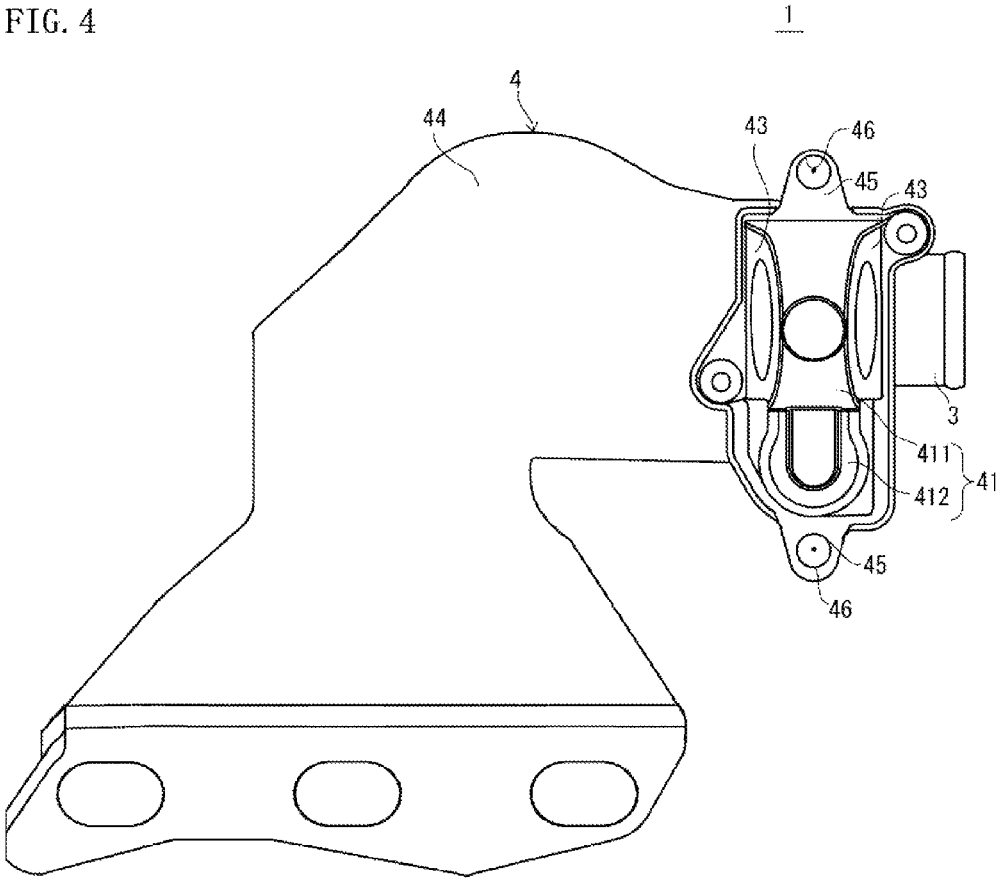
FIG. 4 is a front view showing a passage member in FIG. 1.
Figure 5:
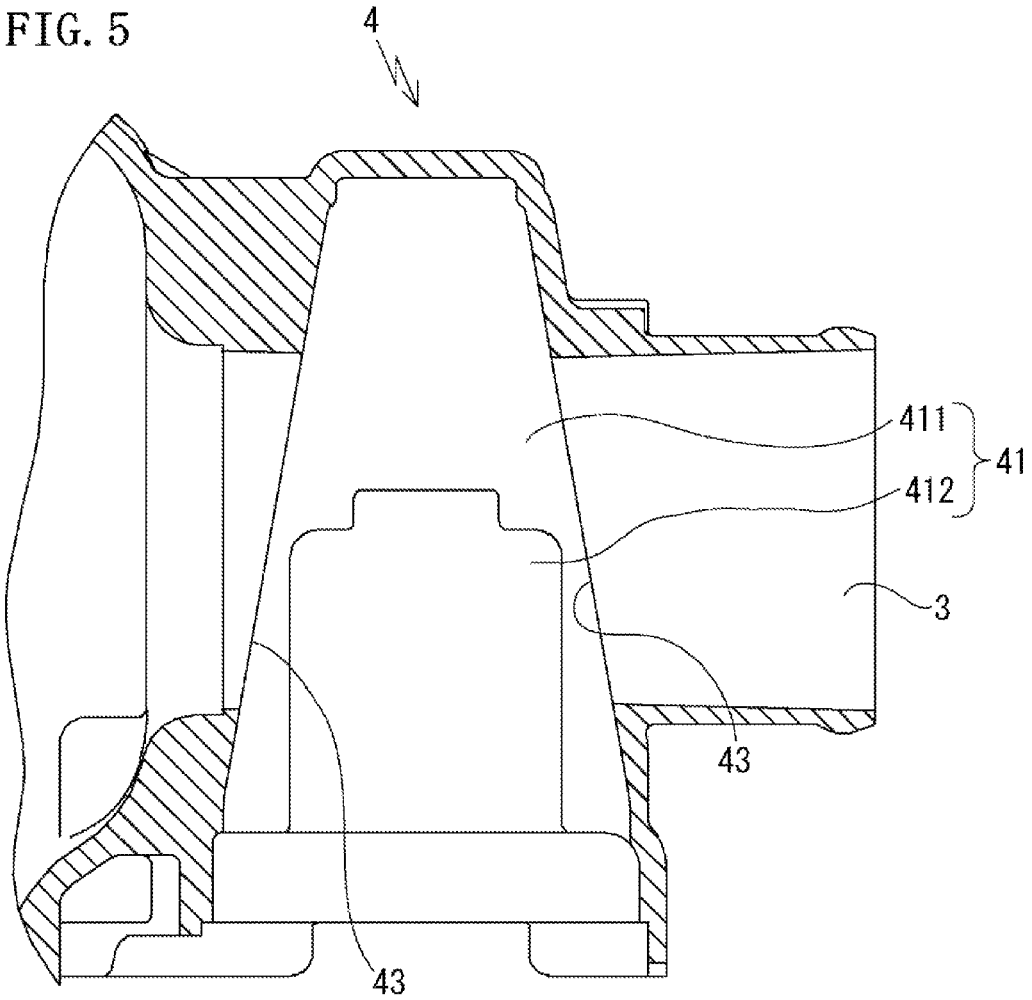
FIG. 5 is a cross sectional view showing a housing chamber in FIG. 4.

The intake air manifold 4 is formed of a resin material, and as shown in FIG. 4, has a housing chamber 41 which accommodates the throttle body 21 and the motor 23. As shown in FIG. 5, the housing chamber 41 has a housing part 411 in which the throttle body 21 is accommodated, and a housing part 412 in which the motor 23 is accommodated. In the housing part 411, there is provided a joint face 43 which is jointed to the end face 21*a* of the throttle body 21, being tapered so as to guide the throttle body 21 into the housing part 411.

As shown in FIG. 4, in the intake air manifold 4, there is formed a part to be fixed 45 to which the fixing part 25 is jointed. In the part to be fixed 45, there is formed an insertion hole 46 penetrating through the part to be fixed 45 in the direction of jointing to the throttle control device 2. In addition, the intake air manifold 4 has a surge tank 44 in the intake air passage 3 located downstream of the throttle body 21.

Figure 6:
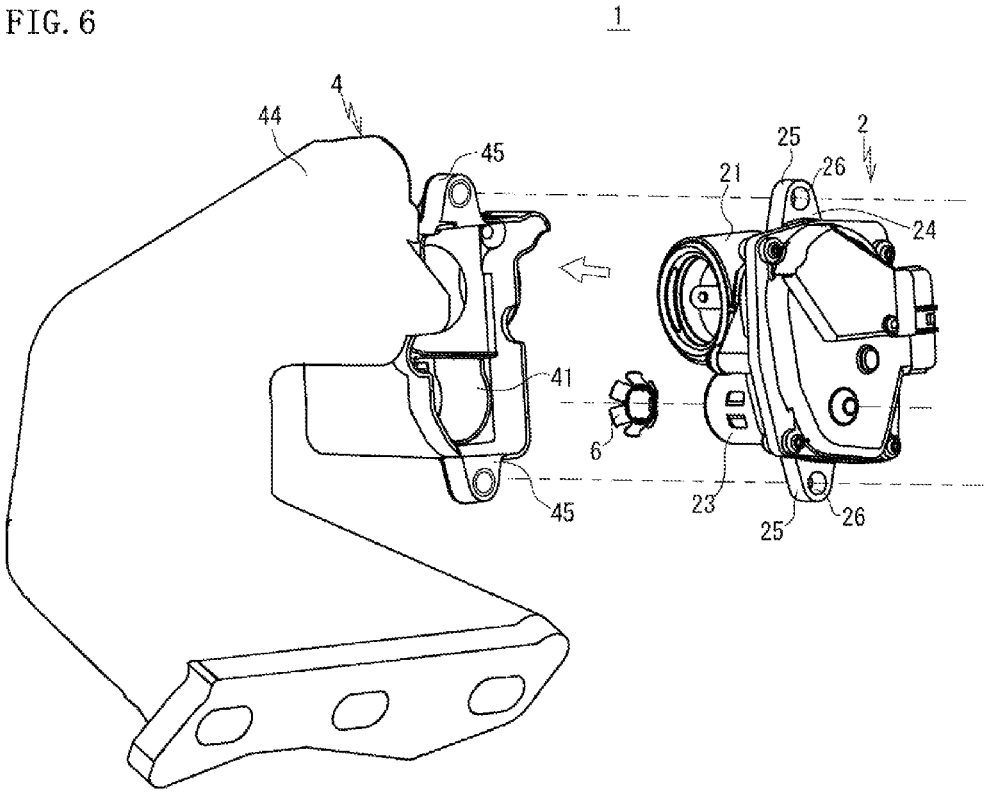
FIG. 6 is an exploded perspective view illustrating a method for assembling between a passage member and a throttle body.

As shown with an arrow in FIG. 6, the support member 24 is assembled to the intake air manifold 4 so as to block the accommodation opening in the housing chamber 41 with the fixing part 25 being jointed to the part to be fixed 45. The fixing part 25 is jointed to the part to be fixed 45 with a bolt inserted into the through-hole 26 being fastened to a nut in the insertion hole 46. The mating face of the fixing part 25 of the support member 24 and that of the part to be fixed 45 formed in the intake air manifold 4 determine the inserting position of the throttle body 21 in the direction of insertion in the intake air passage 3. Further, the fixing part 25 and the part to be fixed 45 are provided in a plane orthogonal to the direction of insertion, respectively, determining the position of the throttle control device 2 in a direction orthogonal to the direction of insertion. In other words, in accommodating the throttle body 21 in the housing chamber 41, the positioning in the direction of insertion and a direction orthogonal to the direction of insertion is defined by the mating faces of the fixing part 25 and the part to be fixed 45.

Figure 7A:
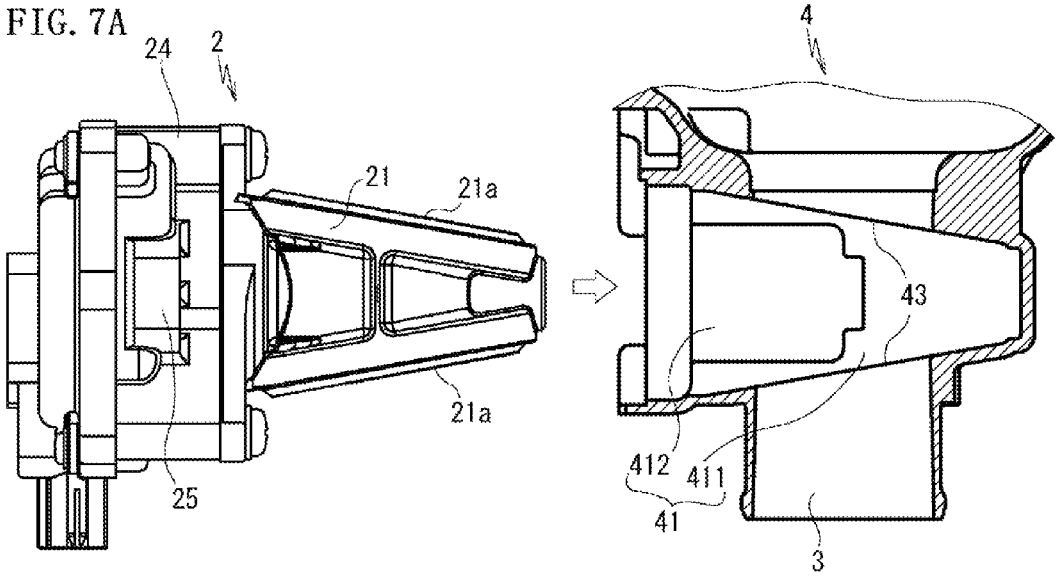
FIG. 7(*a*) and FIG. 7(*b*) are drawings illustrating a method for jointing a throttle bore to the housing chamber.
Figure 7B:
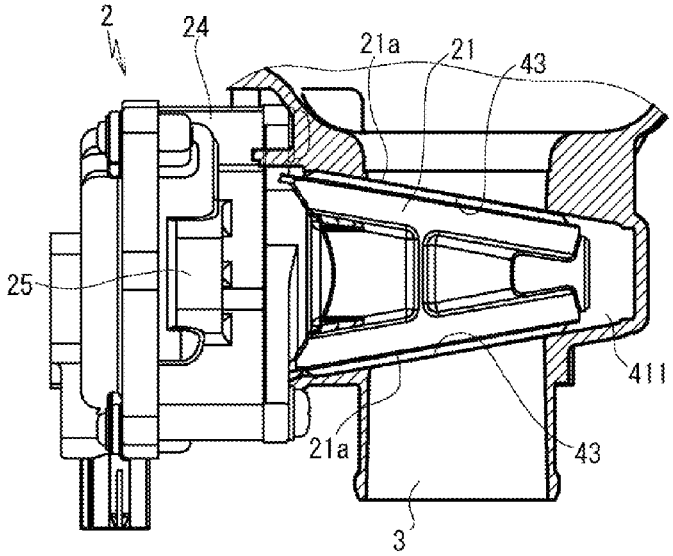

As shown in FIG. 7(*a*) with an arrow, when the support member 24 is assembled to the intake air manifold 4, the end face 21*a* of the throttle body 21 is guided into the housing part 411 by the joint face 43, and is engaged with the joint face 43 as shown in FIG. 7(*b*). Thereby, the throttle body 21 and the motor 23 are accommodated in a predetermined position in the housing chamber 41. The throttle control device 2 is engaged with the housing part 411, both end faces 21*a* of the throttle body 21 being inserted along the joint face 43. The taper of the joint face 43 in the housing part 411 is formed such that it crosses the intake air passage 3, thereby the position of the throttle body 21 in the direction of the passage axis of the intake air passage 3 being defined. With the throttle control device 2 of the present embodiment, the position thereof in the direction of the passage axis of the intake air passage 3 being defined by the end face 21*a* of the throttle body 21 and the joint face 43 formed in the intake air manifold 4, while the position thereof in a direction orthogonal to the passage axis direction of the intake air passage 3 being defined by the mating faces of the fixing part 25 and the part to be fixed 45, as described above.

Figure 8A:
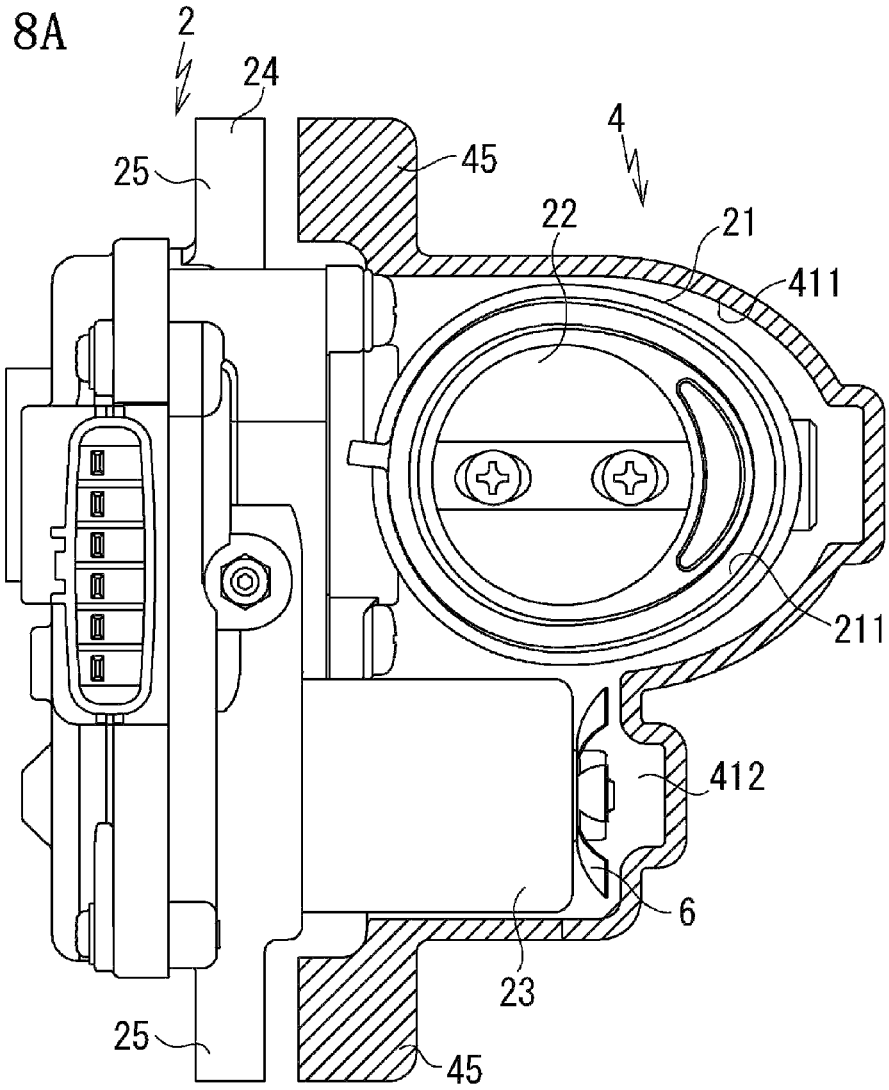
FIG. 8(*a*) and FIG. 8(*b*) are drawings illustrating a method for positioning of a motor in the housing chamber.
Figure 8B:
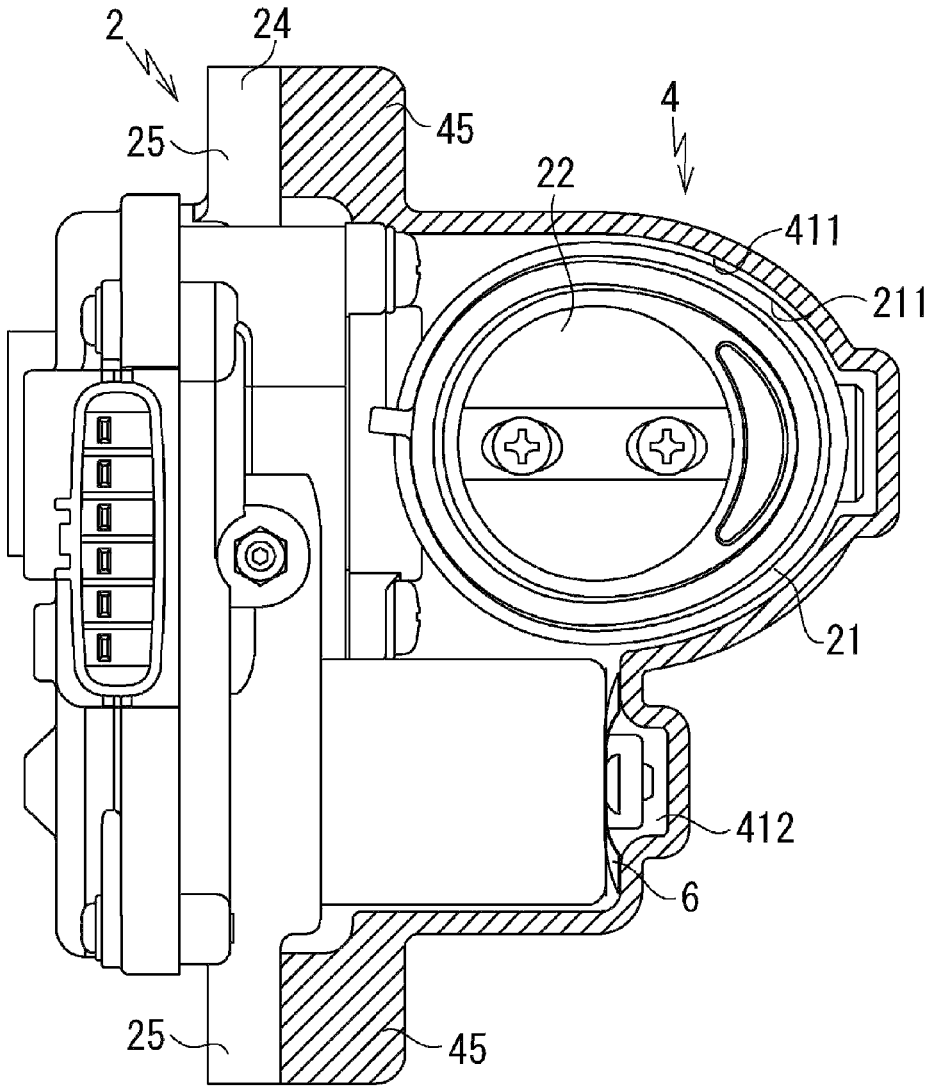

As shown in FIG. 8(*a*), upon the motor 23 being accommodated in the housing part 412, a leaf spring 6 is interposed between the motor 23 and the housing chamber 41 as shown in FIG. 8(*b*). The motor 23 is always urged in a direction reverse to the direction of insertion of the motor 23 into the housing chamber 41. Thereby, vibration of the motor 23 can be suppressed.

According to the present embodiment, by providing the housing chamber 41 for accommodating the throttle body 21 and the motor 23 in the intake air manifold 4, the weight of the throttle body 21 and the motor 23 can be distributed and supported by the intake air manifold 4, whereby the throttle body 21 and the motor 23 can be reliably disposed and held in the intake air passage with no need for reinforcing the fixing part 25 and the part to be fixed 45 to a high strength. In addition, with the fixing part 25 of the support member 24 being jointed to the part to be fixed 45 of the intake air manifold 4, the throttle body 21 and the motor 23 are easily disposed in a predetermined position in the housing chamber 41, whereby the need for providing a complicated manufacturing process can be eliminated, leading to a reduction in cost, and the like.

In addition, according to the present embodiment, the throttle body 21 is guided into the housing chamber 41 by the joint face 43, the end face 21*a* of the throttle body 21 and the joint face 43 in the housing chamber 41 being engaged with each other, whereby the throttle body 21 can be accurately positioned in a predetermined position in the housing chamber 41. In addition, positioning of the throttle body 21 in the axial direction of the intake air passage 3 is performed with the joint face 43, while positioning of the throttle body 21 in a direction orthogonal to the axial direction of the intake air passage 3 is performed with the fixing part 25 and the part to be fixed 45, whereby occurrence of a clearance between the throttle body 21 and the intake air manifold 4 can be suppressed, and an intake air leakage can be prevented from being caused.

Therefore, simplification in construction, and reduction in device size can be achieved, with the manufacturing cost being suppressed. In addition, the reduction in size leads to the reduction in weight, whereby there can be provided a greatly advantageous effect on the improvement in fuel consumption of the vehicle.

Further, the present embodiment has been explained using the intake air manifold 4 as an example of intake air passage member. The intake air manifold 4 is provided with the surge tank 44 on the downstream side of the throttle body 21, and therefore, the layout of the intake air passage 3 from the throttle valve 22 to the engine can be easily altered. Therefore, the housing chamber 41, which provides the mounting position for the throttle body 21, can be designed in a free layout, and therefore the air intake device can be designed for an optimum direction of insertion of the throttle body 21.

The above embodiment has been explained on the assumption that the leaf spring 6 is interposed between the motor 23 and the housing chamber 41. As the urging member to be interposed between the motor 23 and the housing chamber 41, an urging member made of rubber material, such as an O-ring, is preferable besides that made of a spring. Further, the motor 23 accommodated in a predetermined position in the housing chamber 41 may be directly abutted against the intake air manifold 4 so as to be supported by the intake air manifold 4, or may be supported by the support member 24 alone. Such configuration is susceptible to vibration of the motor 23, compared to the configuration having an urging member, however, since the throttle body 21 is supported by the intake air manifold 4 through the engagement with the joint face 43, thereby the effect of vibration on the throttle body 21 is suppressed.

Figure 9A:
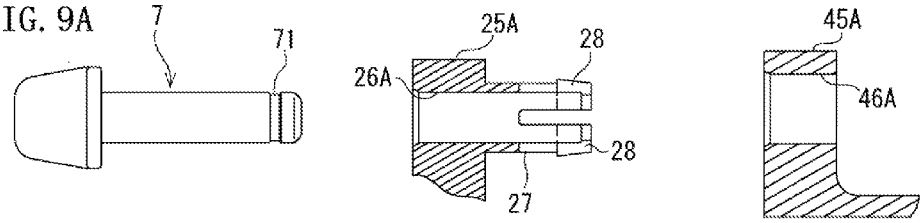
FIG. 9(*a*) and FIG. 9(*b*) are drawings giving an example of method for jointing between a fixing part and a part to be fixed.
Figure 9B:
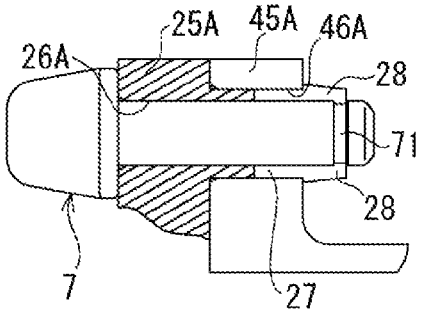

In addition, the method for jointing the support member 24 to the intake air manifold 4 is optional, and for example, the jointing means may be configured as a fixing part 25A and a part to be fixed 45A shown in FIG. 9(*a*) and FIG. 9(*b*). From the joint face of the fixing part 25A, a snap fit part 27 is protruded. The snap fit part 27 extends from the peripheral edge of a through-hole 26A. At the distal end of the snap fit part 27, a plurality of elastically deformable engaging pawls 28 are provided. The engaging pawls 28 are annularly disposed along the distal end edge part of the snap fit part 27.

When a pin 7 is inserted into the snap fit part 27 through the through-hole 26A in a state in which the snap fit part 27 is inserted into the insertion hole 46A, the fixing part 25A is jointed to the part to be fixed 45A with the engaging pawls 28 flexed toward the outside of the through-hole 26 being engaged with the peripheral edge of the insertion hole 46A. The pin 7 is fixed to the part to be fixed 45A with an engaging groove 71 therein being engaged with the engaging claws 28.

With this configuration, the support member 24 is jointed to the intake air manifold 4 with the engaging pawls 28 of the fixing part 25A being engaged with the intake air manifold 4, thereby there being no need for press-fitting a collar or insert nut made of metallic material into the fixing part 25A and the part to be fixed 45A. Thereby, the number of components can be cut, the weight being reduced, and the manufacturing process being simplified.

Figure 10A:
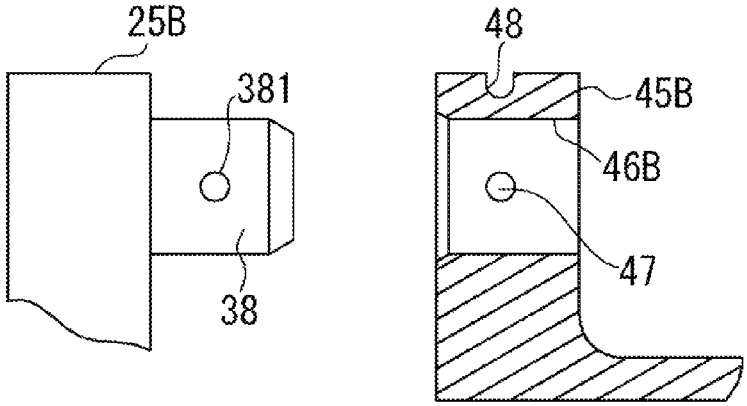
FIG. 10(*a*), FIG. 10(*b*), and FIG. 10(*c*) are drawings giving another example of method for jointing between the fixing part and the part to be fixed.
Figure 10B:
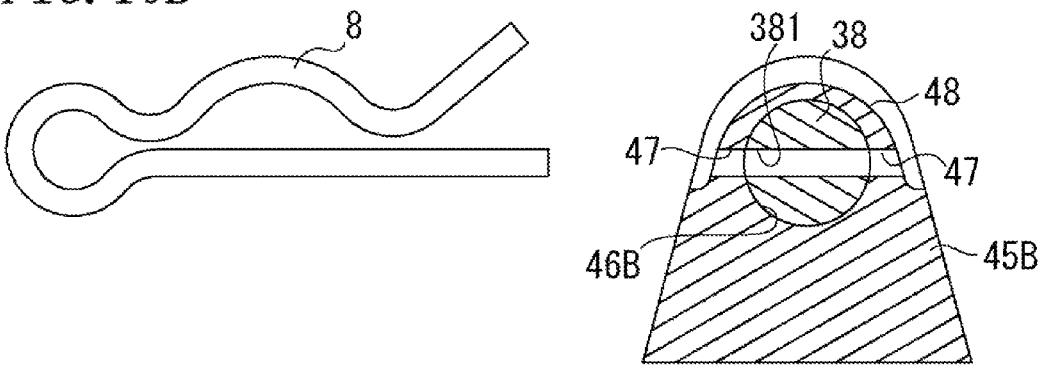
Figure 10C:
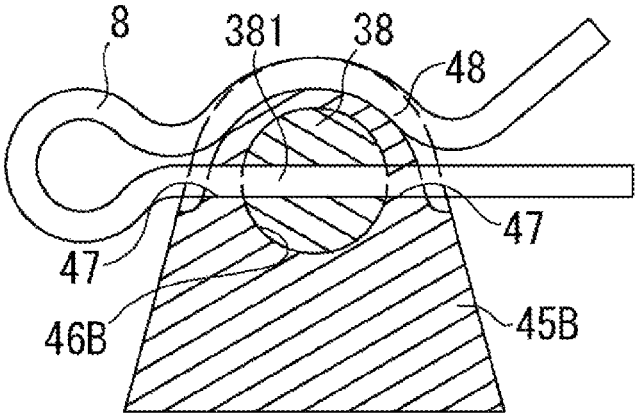

Further, the joint means may be configured as a fixing part 25B and a part to be fixed 45B shown in FIG. 10(*a*), FIG. 10(*b*), and FIG. 10(*c*). As a joint face of the fixing part 25B which is jointed with the part to be fixed 45B, there is provided a projecting part 38 in the outer peripheral face of which a through-hole 381 is opened. Also, in the outer peripheral face of the part to be fixed 45B, a through-hole 47 disposed across the insertion hole 46B, both half portions thereof being opposed, is opened. Further, in the outer peripheral face of the part to be fixed 45B, there is formed an engaging groove 48 extending along the peripheral direction of the part to be fixed 45B. The through-hole 47 is opened at both end parts of the engaging groove 48.

The fixing part 25B and the part to be fixed 45B are fixed to each other with a coming-off preventing pin 8 being inserted into the through-hole 381 and the through-hole 47 in a state in which the projecting part 38 is inserted into the insertion hole 46B, thus the coming-off preventing pin 8 engaging with the part to be fixed 45B. The coming-off preventing pin 8 is accommodated in the engaging groove 48 to be engaged with the part to be fixed 45B.

Also, with this configuration, the fixing part 25B and the part to be fixed 45B are fixed to each other with the coming-off preventing pin 8 inserted into the through-hole 381 and the insertion hole 46B being engaged with the part to be fixed 45B, whereby the number of components can be cut, the weight being reduced, and the manufacturing process being simplified.

Further, the above embodiment has been explained on the assumption that the leaf spring 6 is used as the urging member, the configuration of the urging member is also optional. Also, the configuration of the support member 24 is optional, and the above embodiment takes a configuration in which the throttle body 21 is formed as a separate body to be mounted to the support member 24, however, the support member 24 and the throttle body 21 may be integrally formed.

DESCRIPTION OF SYMBOLS

Symbol 1 denotes an air intake device; 2 a throttle control device; 21 a throttle body; 211 a throttle bore; 21*a* an end face; 22 a throttle valve; 23 a motor; 24 a support member; 25, 25A, and 25B a fixing part; 26, 26A, and 26B a through-hole; 27 a snap fit part; 28 an engaging pawl; 3 an intake air passage; 38 a projecting part; 381 a through-hole; 4 an intake air manifold; 41 a housing chamber; 411 a housing part; 412 a housing part; 43 a joint face; 44 a surge tank; 45, 45A, and 45B a part to be fixed; 46, 46A, and 46B an insertion hole; 47 a through-hole; 48 an engaging groove; 6 a leaf spring; 7 a pin; and 8 a coming-off preventing pin.

The invention claimed is:

1. An air intake device, comprising:

a throttle body having a first end face and a second end face, said throttle body defining a throttle bore;

a throttle valve for opening/closing said throttle bore;

a motor for driving said throttle valve to open/close said throttle valve;

a power transmission mechanism for transmitting drive power of said motor to said throttle valve;

a support member for positioning and holding, on one side, said throttle body and said motor, and positioning and holding, on the other side, said power transmission mechanism; and an intake air manifold formed of a resin material for defining an intake air passage together with said throttle bore, wherein:

said first end face and said second end face of said throttle body provide a wedge-shaped, tapered flange, said intake air manifold is provided with a housing chamber for accommodating said throttle body and said motor, said housing chamber has a housing part in which said throttle body is accommodated, and said housing part is provided with a joint face which is jointed to said first end face and said second end face of said throttle body, the joint face having first and second guide faces which are tapered inwardly with respect to each other so as to guide said throttle body into said housing part and engage with said housing part in a complementary manner.

2. The air intake device according to claim 1, wherein said support member is jointed to said intake air manifold such that an accommodation opening in said housing chamber is blocked.

3. The air intake device according to claim 1, wherein, between said motor and said housing chamber, there is interposed an urging member for urging said motor in a direction reverse to the direction of insertion of said motor into said housing chamber.

4. The air intake device according to claim 1, wherein said support member has a fixing part formed so as to be jointed to said intake air manifold, and said intake air manifold is formed with a part to be fixed to which said fixing part is jointed, wherein the fixing part and the part to be fixed are provided in a plane orthogonal to a direction of insertion, respectively, determining the position of a throttle control device in a direction orthogonal to the direction of insertion.

5. The air intake device according to claim 4, wherein said fixing part has an elastically deformable engaging pawl, and said support member is jointed to said intake air manifold with said engaging pawl being engaged with said intake air manifold.

6. The air intake device according to claim 4, wherein said fixing part has a projecting part, the outer peripheral face thereof having a through-hole opened therein, and said support member is jointed to said intake air manifold by means of an engaging member inserted into said through-hole for engaging said support member with said intake air manifold.

* * * * *